US011435128B2

(12) United States Patent
Liu et al.

(10) Patent No.: US 11,435,128 B2
(45) Date of Patent: Sep. 6, 2022

(54) REFRIGERATOR WITH RETURN AIR INLETS FORMED IN TWO SIDEWALLS OF CABINET

(71) Applicants: QINGDAO HAIER REFRIGERATOR CO., LTD., Shandong (CN); HAIER SMART HOME CO., LTD., Shandong (CN)

(72) Inventors: Shanshan Liu, Qingdao (CN); Dongqiang Cao, Qingdao (CN); Wei Li, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 0 days.

(21) Appl. No.: 17/434,272

(22) PCT Filed: Feb. 18, 2020

(86) PCT No.: PCT/CN2020/075703
§ 371 (c)(1),
(2) Date: Aug. 26, 2021

(87) PCT Pub. No.: WO2020/173338
PCT Pub. Date: Sep. 3, 2020

(65) Prior Publication Data

US 2022/0042734 A1 Feb. 10, 2022

(30) Foreign Application Priority Data

Feb. 26, 2019 (CN) ..... 201910142805.2

(51) Int. Cl.
*F25D 17/04* (2006.01)
*F25D 11/02* (2006.01)
(Continued)

(52) U.S. Cl.
CPC ..... *F25D 17/045* (2013.01); *F25D 11/022* (2013.01); *F25D 17/065* (2013.01);
(Continued)

(58) Field of Classification Search
CPC ..... F25D 2317/067; F25D 2317/065; F25D 17/08; F25D 11/022; F25D 17/0965;
(Continued)

(56) References Cited

U.S. PATENT DOCUMENTS 3,122,005 A 2/1964 Costantini et al.
3,733,836 A 5/1973 Corini
(Continued)

FOREIGN PATENT DOCUMENTS

CN 102297556 A 12/2011
CN 202154378 U 3/2012
(Continued)

OTHER PUBLICATIONS

International Search Report for PCT/CN2020/075703 (ISA/CN) dated May 21, 2020 with English translation (4 pages).
(Continued)

*Primary Examiner* — Cassey D Bauer
(74) *Attorney, Agent, or Firm* — Alston & Bird LLP

(57) ABSTRACT

A refrigerator (100) includes: a cabinet (110), in which are defined a cooling chamber (150) at a lower portion and a first storage compartment and a second storage compartment which are spaced side by side above the cooling chamber (150); and an evaporator, arranged in the cooling chamber (150) and configured to cool an airflow entering the cooling chamber (150) to form a cooled airflow. At least one first return air inlet communicated with the cooling chamber (150) is formed in a left sidewall of the first storage compartment such that a return airflow of the first storage compartment enters the cooling chamber (150) to be cooled
(Continued)

via the first return air inlet. At least one second return air inlet communicated with the cooling chamber (150) is formed in a right sidewall of the second storage compartment such that a return airflow of the second storage compartment enters the cooling chamber (150) to be cooled via the second return air inlet. The available compartment volume of the refrigerator is increased, and the return air inlets communicated with the cooling chamber (150) are formed in left and right sidewalls of the cabinet respectively.

6 Claims, 4 Drawing Sheets

(51) Int. Cl.
*F25D 17/06* (2006.01)
*F25D 17/08* (2006.01)

(52) U.S. Cl.
CPC ..... *F25D 17/08* (2013.01); *F25D 2317/067* (2013.01); *F25D 2317/0651* (2013.01)

(58) Field of Classification Search
CPC ..... F25D 17/045; F25D 2317/0671; F25D 2317/0672; F25D 2317/0663; F25D 2317/0654; F25D 17/065; F25D 2317/0651; A47F 3/0408; A47F 3/0413
See application file for complete search history.

(56) References Cited

U.S. PATENT DOCUMENTS

| | | | | |
|---|---|---|---|---|
| 5,809,798 | A | 9/1998 | Clarke et al. | |
| 2018/0087824 | A1* | 3/2018 | Han | F25D 17/065 |

FOREIGN PATENT DOCUMENTS

| | | | | | |
|---|---|---|---|---|---|
| CN | 105222460 | A | | 1/2016 | |
| CN | 105783368 | A | | 7/2016 | |
| CN | 205383831 | U | | 7/2016 | |
| CN | 106500199 | A | | 3/2017 | |
| CN | 107990616 | A | | 5/2018 | |
| CN | 108489173 | A | | 9/2018 | |
| CN | 108759249 | A | | 11/2018 | |
| CN | 108826787 | A | | 11/2018 | |
| CN | 108870839 | A | | 11/2018 | |
| DE | 1743237 | U | | 4/1957 | |
| DE | 19542978 | | * | 5/1997 | A47F 3/04743 |
| GB | 808696 | A | | 2/1959 | |
| JP | S58175736 | A | | 10/1983 | |

OTHER PUBLICATIONS

Written Opinion of the International Searching Authority for PCT/CN2020/075703 (ISA/CN) dated May 14, 2020 with English translation (6 pages).
Search Report for China Application No. 201910142805.2 dated Jan. 5, 2021 (3 pages).
Office Action for China Application No. 201910142805.2 dated Jan. 12, 2021 (6 pages).
1st Office Action for EP Application No. 20763168.0 dated Apr. 5, 2022 (5 pages).
European Search Report for EP Application No. 20763168.0 dated Mar. 24, 2022 (4 pages).

* cited by examiner

REFRIGERATOR WITH RETURN AIR INLETS FORMED IN TWO SIDEWALLS OF CABINET

TECHNICAL FIELD

The present invention relates to the technical field of refrigeration and freezing devices, and in particular relates to a refrigerator.

BACKGROUND ART

A freezing air duct of a conventional side-by-side refrigerator is usually placed on the surface of a rear sidewall. The air duct consisting of an evaporator, an air supply fan, and front and rear air duct cover plates is relatively thick and occupies a rear space of a compartment, and consequently, the available volume may be greatly reduced. In addition, cold air is supplied to a storage compartment by the air supply fan. Since a freezer compartment has a relatively large space, an air delivery path is long, the loss of the refrigeration capacity is great, and the air volume at a position farther away from an air vent is smaller. Moreover, a water pan is usually designed into a funnel shape to ensure that melted frost smoothly flows out. The space of this part of the existing refrigerator is not utilized, which results in the loss of the available volume.

SUMMARY OF THE INVENTION

An objective of the present invention is to provide a refrigerator with a large available compartment volume.

A further objective of the present invention is to provide a refrigerator capable of implementing the effective utilization of a funnel-shaped space of a water pan.

Particularly, the present invention provides a refrigerator, which includes:

a cabinet, in which are defined a cooling chamber at a lower portion and a first storage compartment and a second storage compartment which are spaced side by side above the cooling chamber; and an evaporator, arranged in the cooling chamber and configured to cool an airflow entering the cooling chamber to form a cooled airflow.

At least one first return air inlet communicated with the cooling chamber is formed in a left sidewall of the first storage compartment such that a return airflow of the first storage compartment enters the cooling chamber to be cooled via the first return air inlet.

At least one second return air inlet communicated with the cooling chamber is formed in a right sidewall of the second storage compartment such that a return airflow of the second storage compartment enters the cooling chamber to be cooled via the second return air inlet.

Optionally, the refrigerator further includes a water pan, arranged below the evaporator and having a first inclined portion, a second inclined portion, and a water outlet formed at a bottom junction of the first inclined portion and the second inclined portion. The evaporator has a first evaporator portion abutting on the first inclined portion and a second evaporator portion abutting on the second inclined portion.

Optionally, a top of the first inclined portion is arranged close to the first return air inlet, and a top of the second inclined portion is arranged close to the second return air inlet.

Optionally, the refrigerator further includes: a first top cover plate, arranged above the evaporator and having an inclined plane which is arranged corresponding to the first inclined portion with the first evaporator portion arranged therebetween; and a second top cover plate, arranged above the evaporator and having an inclined plane which is arranged corresponding to the second inclined portion with the second evaporator portion arranged therebetween.

Optionally, the refrigerator further includes an air supply duct, formed between the first storage compartment and the second storage compartment. The air supply duct has at least one first air supply opening communicated with the first storage compartment and at least one second air supply opening communicated with the second storage compartment such that the cooled airflow is delivered to the first storage compartment via the first air supply opening and to the second storage compartment via the second air supply opening.

Optionally, the refrigerator further includes an air supply fan, configured to cause the cooled airflow to flow to the first storage compartment and/or the second storage compartment.

Optionally, the air supply fan is a cross-flow fan arranged between the first evaporator portion and the second evaporator portion. An air outlet of the cross-flow fan is communicated with the air supply duct. The cooled airflow is driven by the cross-flow fan to enter the air supply duct.

Optionally, the refrigerator further includes a first air duct separator having the first air supply opening formed therein; and a second air duct separator having the second air supply opening formed therein. The first air duct separator and the second air duct separator are arranged opposite to each other with the air supply duct formed therebetween.

Optionally, the refrigerator further includes: a first supporting block, arranged in front of a rear sidewall of the cabinet; and a second supporting block, arranged in the front of the cabinet and opposite to the first supporting block. The first air duct separator and the second air duct separator are fixed by the first supporting block and the second supporting block.

Optionally, the refrigerator further includes a reinforcing column, arranged in the first supporting block and/or the second supporting block to improve the strength thereof.

Optionally, both the first storage compartment and the second storage compartment are freezer compartments.

According to the refrigerator of the present invention, the evaporator is arranged at the bottom, so that the available compartment volume is increased. Moreover, the return air inlets communicated with the cooling chamber are formed in left and right sidewalls of the cabinet respectively, so that the return airflows of the storage compartments enter the cooling chamber to be cooled via the return air inlets, without a need for drawers in the compartments to give way.

Further, the evaporator of the refrigerator of the present invention has the first evaporator portion abutting on the first inclined portion and the second evaporator portion abutting on the second inclined portion, so that the funnel-shaped space of the water pan may be utilized effectively, and thus the space utilization rate is increased, and energy conservation is facilitated.

Further, the air supply duct is formed between the first storage compartment and the second storage compartment of the refrigerator of the present invention, so that a gap between the first storage compartment and the second storage compartment is utilized effectively. The cross-flow fan is adopted to supply cold air from the evaporator portions on both sides to the storage compartments, so that the compartment volume is increased, the evaporation area is enlarged, and the air supply path is shortened.

The above, as well as other objectives, advantages and features of the present invention, will be better understood by those skilled in the art according to the following detailed description of specific embodiments of the present invention taken in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In figures.

DETAILED DESCRIPTION OF THE INVENTION

Figure 1:
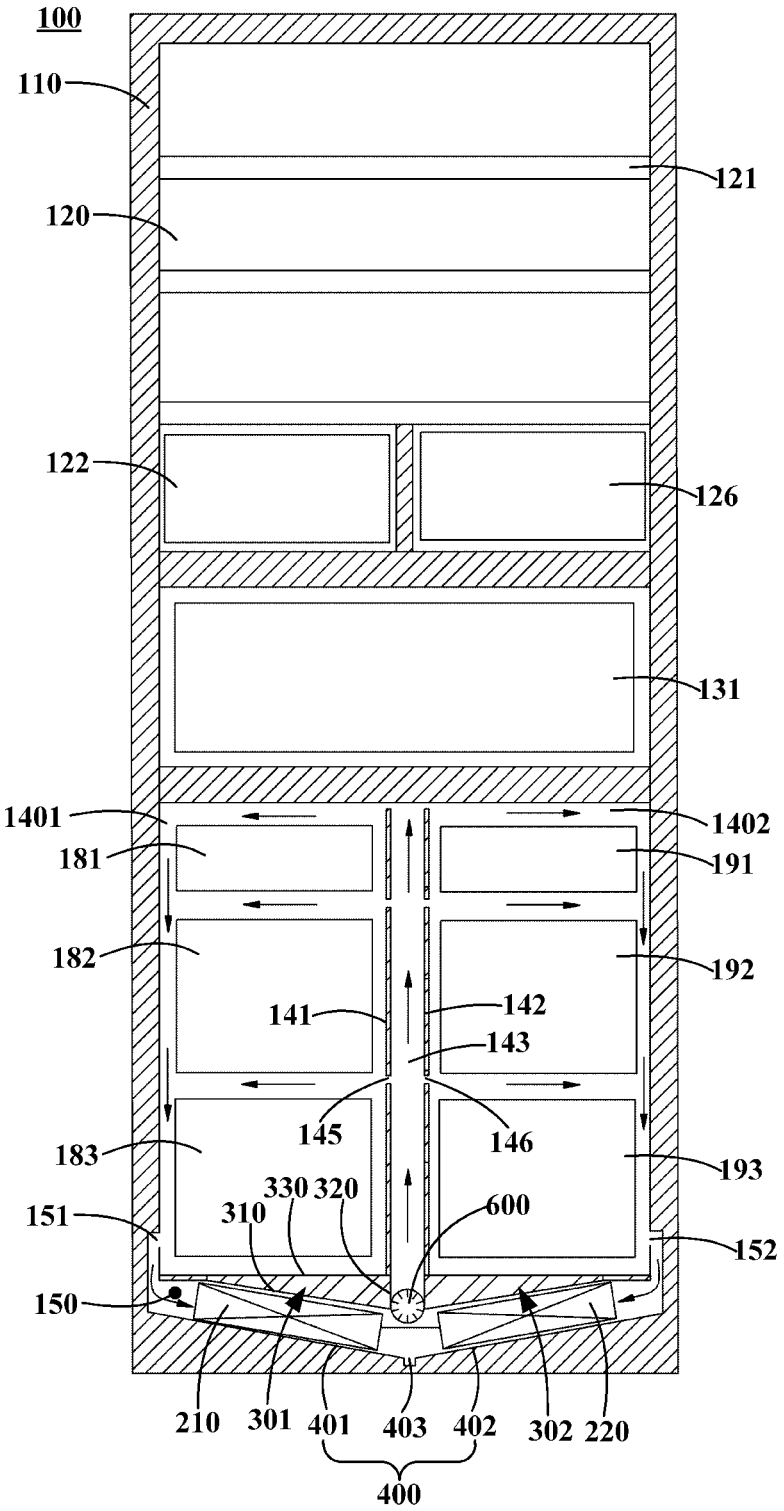
FIG. 1 is a schematic front sectional view of a refrigerator according to an embodiment of the present invention.
Figure 2:
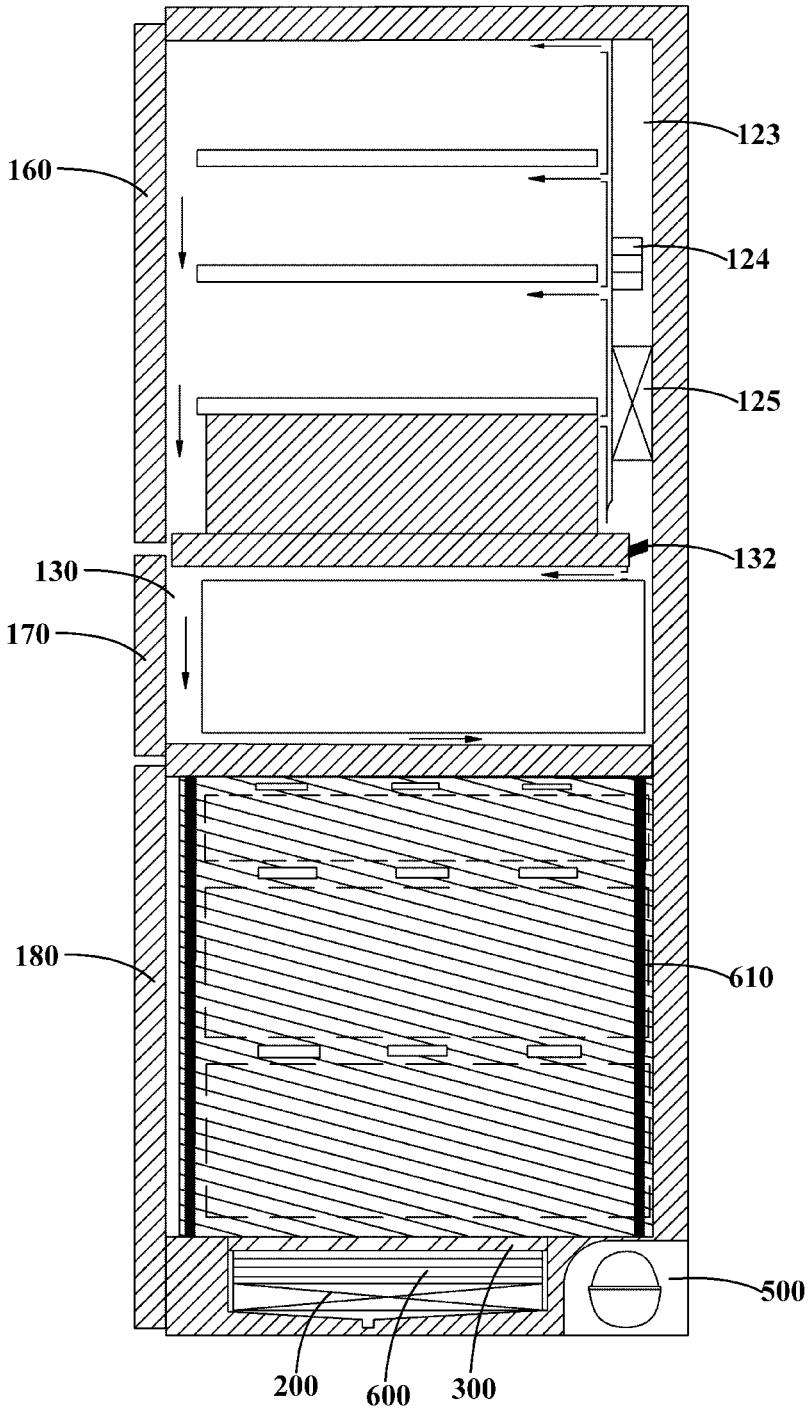
FIG. 2 is a schematic side sectional view of a refrigerator according to an embodiment of the present invention.
Figure 3:
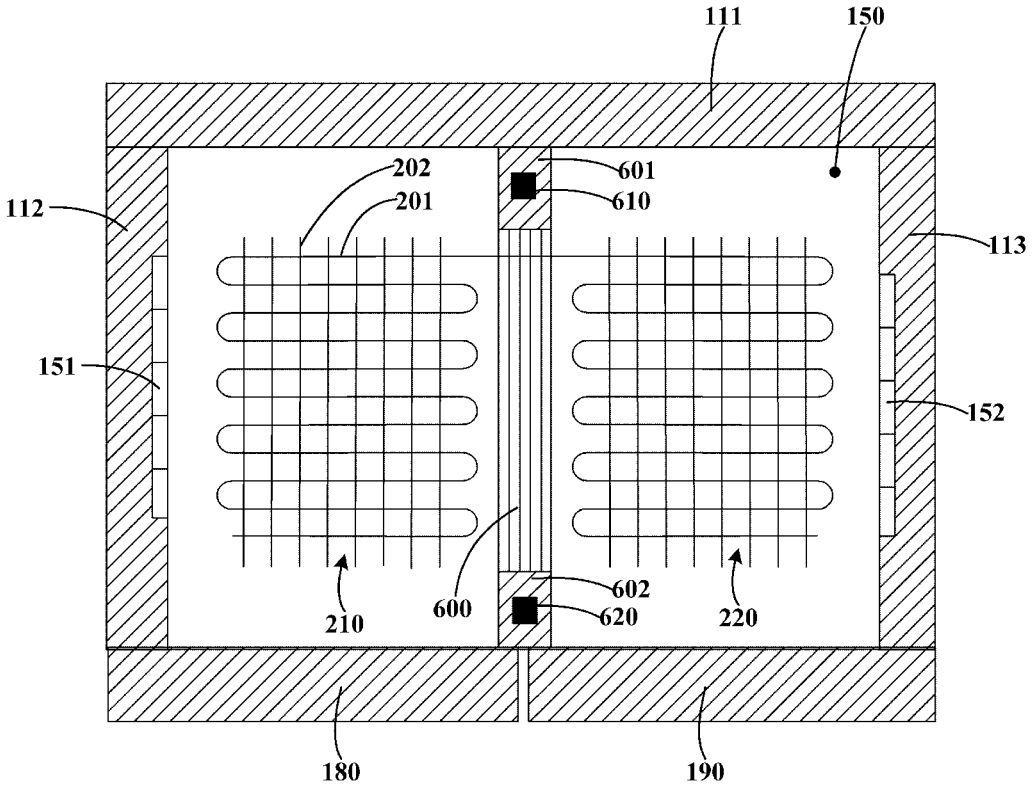
FIG. 3 is a schematic top view of a freezing evaporator of the refrigerator shown in FIG. 1.

FIG. 1 is a schematic front sectional view of a refrigerator 100 according to an embodiment of the present invention. FIG. 2 is a schematic side sectional view of a refrigerator 100 according to an embodiment of the present invention. FIG. 3 is a schematic top view of a freezing evaporator 200 of the refrigerator 100 shown in FIG. 1. In the following descriptions, orientation or position relationships indicated by terms "front", "rear", "upper", "lower", "left", "right", and the like are orientations based on the refrigerator 100.

The refrigerator 100 of the embodiments of the present invention may generally include a cabinet 110. The cabinet 110 includes a housing and a storage liner arranged on an inner side of the housing. A space between the housing and the storage liner is filled with a thermal insulation material (forming a foamed layer). Storage compartments are defined in the storage liner. In an embodiment, the storage compartments include a refrigeration compartment 120, a variable temperature compartment 130, a first freezer compartment 1401, and a second freezer compartment 1402. A cooling chamber 150 is formed below the first freezer compartment 1401 and the second freezer compartment 1402 in the cabinet 110.

A first rotary door body 160 is arranged on a front side of the refrigeration compartment 120 to open or close the refrigeration compartment 120. Multiple separators 121 are arranged in the refrigeration compartment 120 to divide a refrigeration storage space into several portions. A first refrigeration drawer 122 and a second refrigeration drawer 126 are further arranged below the lowest separator 121. A refrigeration air supply duct 123 is formed at a rear sidewall 111 of the refrigeration compartment 120. The refrigeration air supply duct 123 has a refrigeration air supply opening communicated with the refrigeration compartment 120. A refrigeration evaporator 125 and a refrigeration air supply fan 124 are arranged in the refrigeration air supply duct 123.

A withdrawable door body 170 is arranged on a front side of the variable temperature compartment 130, and a variable temperature drawer 131 is placed in the variable temperature compartment. A variable temperature air supply duct is formed at a rear sidewall 111 of the variable temperature compartment 130. The variable temperature air supply duct is communicated with the refrigeration air supply duct 123, and a variable temperature damper 132 is arranged therebetween. The variable temperature damper 132 is opened by a certain angle when a cooled airflow is required to be delivered to the variable temperature compartment 130.

A left rotary door body 180 is arranged on a front side of the first freezer compartment 1401, and a left-side first freezer drawer 181, a left-side second freezer drawer 182, and a left-side third freezer drawer 183 are defined from top to bottom in the first freezer compartment. A right rotary door body 190 is arranged on a front side of the second freezer compartment 1402, and a right-side first freezer drawer 191, a right-side second freezer drawer 192, and a right-side third freezer drawer 193 are defined from top to bottom in the second freezer compartment. As known to those skilled in the art, the temperature of the refrigeration compartment 120 is usually 2° C. to 10° C., preferably 4° C. to 7° C. The temperatures of the first freezer compartment 1401 and the second freezer compartment 1402 usually range from −22° C. to −14° C. The variable temperature compartment 130 may be freely adjusted to −18° C. to 8° C. For different kinds of items, optimum storage temperatures are different, and suitable storage positions are also different. For example, fruits and vegetables are suitable to be stored in the refrigeration compartment 120, and meat is suitable to be stored in the first freezer compartment 1401 and the second freezer compartment 1402.

A freezing evaporator 200 is arranged in the cooling chamber 150 and configured to cool an airflow entering the cooling chamber 150 to form a cooled airflow, and has a coil 201 and multiple fins 202 arranged on the coil 201 in a penetration manner. The cabinet 110 of the refrigerator 100 of the embodiment of the present invention includes a top wall, a bottom wall 504, a rear sidewall 111, a left sidewall 112, and a right sidewall 113. Multiple first freezing return air inlets 151 communicated with the cooling chamber 150 are formed in a left sidewall of the first freezer compartment 1401 such that a return airflow of the first freezer compartment 1401 enters the cooling chamber 150 to be cooled via the first freezing return air inlets 151. Multiple second freezing return air inlets 152 communicated with the cooling chamber 150 are formed in a right sidewall of the second freezer compartment 1402 such that a return airflow of the second freezer compartment 1402 enters the cooling chamber 150 to be cooled via the second freezing return air inlets 152. According to the refrigerator 100 of the present invention, the freezing evaporator 200 is arranged at the bottom, so that the available compartment volume is increased. Moreover, the return air inlets communicated with the cooling chamber 150 are formed in the left and right sidewalls of the cabinet 110 respectively, so that the return airflows of the storage compartments enter the cooling chamber 150 to be cooled via the return air inlets, without a need for drawers in the compartments to give way.

The refrigerator 100 of the embodiment of the present invention further includes a water pan 400, which is arranged below the freezing evaporator 200 and has a first inclined portion 401, a second inclined portion 402, and a water outlet 403 formed at a bottom junction of the first inclined portion 401 and the second inclined portion 402. A top of the first inclined portion 401 is arranged close to the first freezing return air inlets 151, and a top of the second inclined portion 402 is arranged close to the second freezing return air inlets 152. The freezing evaporator 200 has a first evaporator portion 210 abutting on the first inclined portion 401 and a second evaporator portion 220 abutting on the second inclined portion 402. The freezing evaporator 200 of the refrigerator 100 of the present invention has the first evaporator portion 210 abutting on the first inclined portion 401 and the second evaporator portion 220 abutting on the second inclined portion 402, so that the funnel-shaped space of the water pan 400 may be utilized effectively.

The refrigerator 100 of the embodiment of the present invention further includes a first top cover plate 301 and a second top cover plate 302. The first top cover plate 301 has an inclined plane 310, a horizontal plane 330, and a vertical plane 320. The second top cover plate 302 has an inclined plane 310, a horizontal plane 330, and a vertical plane 320. The vertical plane 320 of the first top cover plate 301 is arranged opposite to the vertical plane 320 of the second top cover plate 302. The inclined plane 310 of the first top cover plate 301 is arranged corresponding to the first inclined portion 401, and the first evaporator portion 210 is arranged therebetween. The inclined plane 310 of the second top cover plate 302 is arranged corresponding to the second inclined portion 402, and the second evaporator portion 220 is arranged therebetween. According to the refrigerator 100 of the present invention, the first top cover plate 301 and the second top cover plate 302 are arranged above the freezing evaporator 200, so that the fixation firmness of the freezing evaporator 200 may be improved.

The refrigerator 100 of the embodiment of the present invention further includes a freezing air supply duct 143, a first air duct separator 141, a second air duct separator 142, a first supporting block 601, and a second supporting block 602. Multiple first freezing air supply openings 145 are formed in the first air duct separator 141. Multiple second freezing air supply openings 146 are formed in the second air duct separator 142. The first air duct separator 141 and the second air duct separator 142 are arranged opposite to each other with the freezing air supply duct 143 formed therebetween. The refrigerator 100 of the embodiment of the present invention further includes a cross-flow fan 600 arranged between the first evaporator portion 210 and the second evaporator portion 220. An air outlet of the cross-flow fan 600 is communicated with the freezing air supply duct 143. The cooled airflow is driven by the cross-flow fan 600 to enter the freezing air supply duct 143, so that the return airflow can be cooled by full use of the freezing evaporator 200. A linear cross-flow fan 600 is adopted according to the length of the evaporator. The first supporting block 601 is arranged in front of the rear sidewall 111 of the cabinet 110. The second supporting block 602 is arranged in the front of the cabinet 110 and opposite to the first supporting block 601. The first air duct separator 141 and the second air duct separator 142 are fixed by the first supporting block 601 and the second supporting block 602. In order to improve the strength, a reinforcing column 610 is arranged in the first supporting block 601, and a reinforcing column 620 is arranged in the second supporting block 602.

Figure 4:
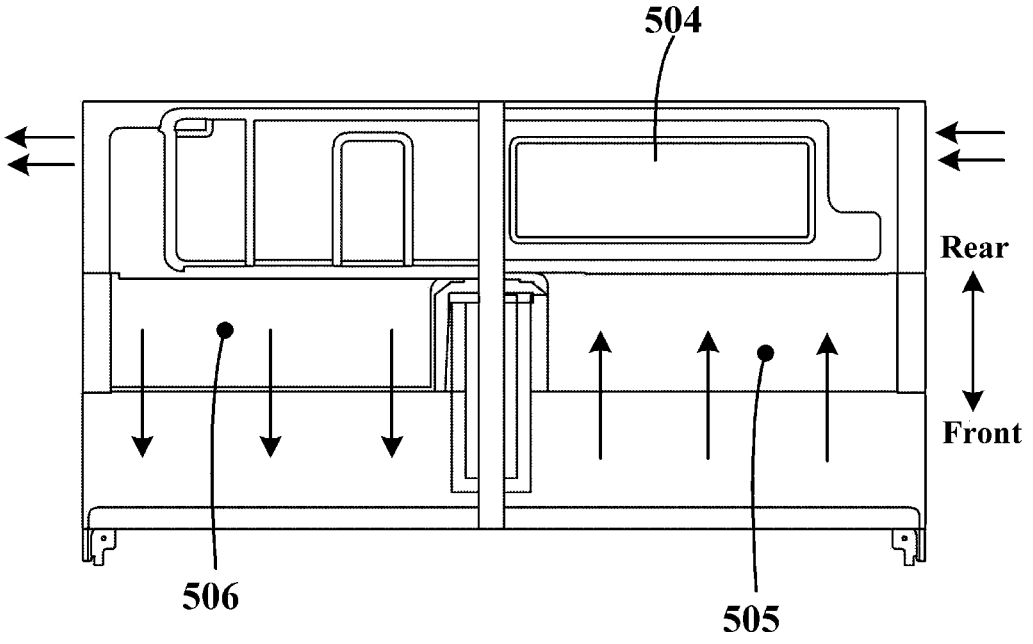
FIG. 4 is a schematic bottom view of a refrigerator according to an embodiment of the present invention.
Figure 5:
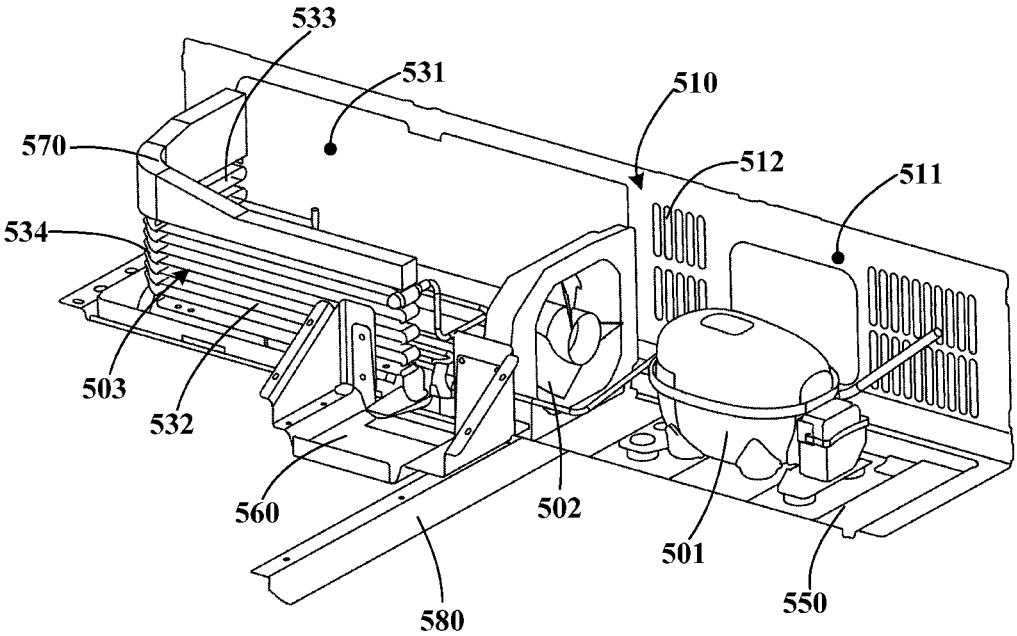
FIG. 5 is a schematic three-dimensional diagram of main components of a compressor compartment of the refrigerator shown in FIG. 4.
Figure 6:
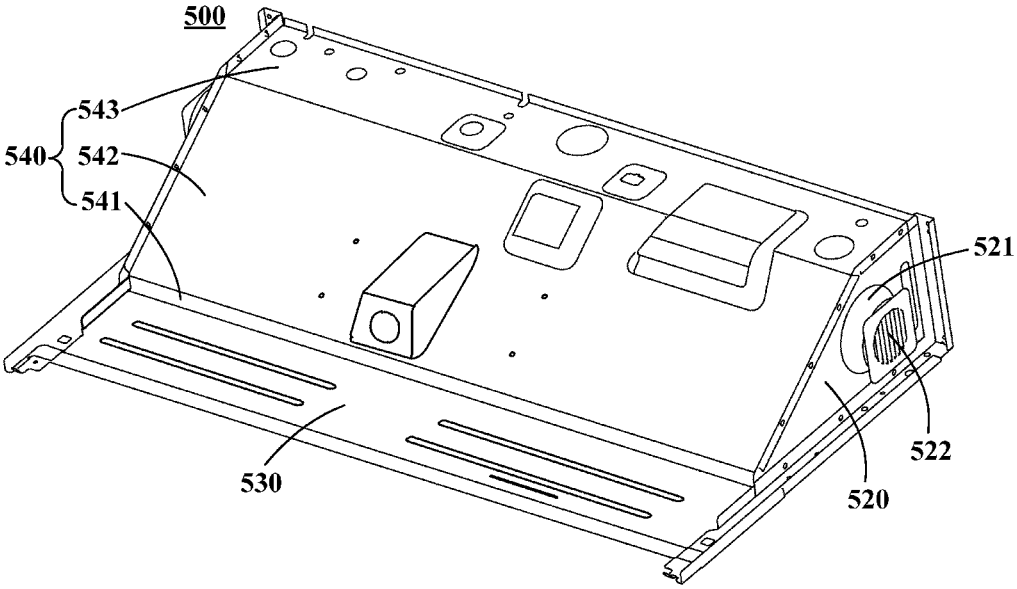
FIG. 6 is a schematic three-dimensional diagram of a compressor compartment of the refrigerator shown in FIG. 4.

FIG. 4 is a schematic bottom view of a refrigerator 100 according to an embodiment of the present invention. FIG. 5 is a schematic three-dimensional diagram of main components of a compressor compartment 500 of the refrigerator 100 shown in FIG. 4. FIG. 6 is a schematic three-dimensional diagram of a compressor compartment 500 of the refrigerator 100 shown in FIG. 4. A compressor compartment 500 is defined at a bottom of the cabinet 110 of the refrigerator 100 of the embodiment of the present invention. The compressor compartment 500 is behind the cooling chamber 150 and thus wholly below the first freezer compartment 1401 and the second freezer compartment 1402. As described above, the first freezer compartment 1401 and the second freezer compartment 1402 are not required to give way to the compressor compartment 500, and the depths of the first freezer compartment 1401 and the second freezer compartment 1402 are ensured to facilitate placement of items which are relatively large and difficult to separate. The refrigerator 100 further includes a heat dissipation fan 502. The heat dissipation fan 502 may be an axial-flow fan. A compressor 501, the heat dissipation fan 502, and a condenser 503 are transversely spaced in sequence in the compressor compartment 500.

In some embodiments, at least one rear air outlet 512 is formed in a section 511 of a rear wall (i.e., a back plate 510) of the compressor compartment 500 corresponding to the compressor 501.

Before the present invention, those skilled in the art usually have two design thoughts. One is that a rear air inlet (not shown in the figure) facing the condenser 503 and a rear air outlet 512 facing the compressor 501 are formed in the rear wall of the compressor compartment 500 respectively to complete the circulation of a heat dissipation airflow at the rear wall of the compressor compartment 500. The other is that air vents are formed in a front wall and the rear wall of the compressor compartment 500 respectively to form a heat dissipation circulating air path in a front-rear direction. When it is desirable to improve the heat dissipation effect of the compressor compartment 500, those skilled in the art usually increase the numbers of the rear air inlets and the rear air outlets 512 in the rear wall of the compressor compartment 500 to enlarge the ventilation area, or enlarge the heat exchange area of the condenser 503, for example, adopt a U-shaped condenser with a larger heat exchange area.

The inventor creatively realizes that the heat exchange area of the condenser 503 and the ventilation area of the compressor compartment 500 are not as larger as better. The conventional design solution of enlarging the heat exchange area of the condenser 503 and the ventilation area of the compressor compartment 500 may bring the problem of non-uniform heat dissipation of the condenser 503 to adversely affect a refrigeration system of the refrigerator 100. Therefore, it is proposed in the present invention to define a bottom air inlet 505 close to the condenser 503 and a bottom air outlet 506 close to the compressor 501, which are transversely arranged, on the bottom wall of the cabinet 110 to complete the circulation of the heat dissipation airflow at the bottom of the refrigerator 100 without prolonging the distance between the rear wall of the cabinet 110 and a cupboard. The heat from the compressor compartment 500 may be dissipated well while the space occupied by the refrigerator 100 is reduced, the sore point that the heat dissipation of the compressor compartment 500 and the space occupation of the embedded refrigerator 100 cannot be balanced is radically solved, and particular significance is achieved. Support rollers (not shown in the figures) may further be arranged in the four corners of the bottom wall 504 of the cabinet 110. The cabinet 110 is placed on a supporting plane through the four support rollers with a certain space formed between the bottom wall 504 of the cabinet 110 and the supporting plane.

The heat dissipation fan 502 is configured to cause ambient air around the bottom air inlet 505 to enter the compressor compartment 500 via the bottom air inlet 505, sequentially pass through the condenser 503 and the compressor 501, and then flow via the bottom air outlet 506 to an external environment to dissipate heat from the compressor 501 and the condenser 503. In a vapor compression refrigeration cycle, the surface temperature of the condenser 503 is generally lower than that of the compressor 501, so the external air is made to cool the condenser 503 first and then cool the compressor 501 in the process above.

In a preferred embodiment, a plate section 531 of the back plate 510 facing the condenser 503 is a continuous plate, namely no heat dissipation holes are formed in the plate section 531. The inventor creatively realizes that reducing the ventilation area of the compressor compartment 500 without enlarging the heat exchange area of the condenser 503 may form a good heat dissipation airflow path and achieve a relatively good heat dissipation effect. This is because the plate section 531 is a continuous plate, so that the heat dissipation airflow entering the compressor compartment 500 can be sealed at the condenser 503, thus the heat exchange uniformity of each condensation section of the condenser 503 is ensured, the formation of a better heat dissipation airflow path is facilitated, and a relatively good heat dissipation effect may still be achieved. In addition, since the plate section 531 is a continuous plate, the adverse impact brought to the heat exchange of the condenser 503 by the fact that, in the conventional design, air exhaust and air supply are concentrated in the back of the compressor compartment 500 and thus hot air blown from the compressor compartment 500 enters the compressor compartment 500 again before being timely cooled by the ambient air is avoided, and the heat exchange efficiency of the condenser 503 is ensured.

In some embodiments, side air vents 521 are transversely formed in the two sidewalls of the compressor compartment 500 respectively. The side air vent 521 is covered with a ventilation cover plate 522. Grid-type small air vents are formed in the ventilation cover plate 522. Side openings corresponding to the side air vents 521 are formed in the two sidewalls of the cabinet 110 respectively such that the heat dissipation airflow flows out of the refrigerator 100. As such, additional heat dissipation paths are further formed, and the heat dissipation effect of the compressor compartment 500 is ensured. It can be understood that the two sidewalls of the cabinet 110 may be directly used as the sidewalls of the compressor compartment 500. For example, as shown in FIG. 6, side plates 520 form the sidewalls of the cabinet 110 as well as the sidewalls of the compressor compartment 500.

In a preferred embodiment, the condenser 503 includes a first straight section 532 extending transversely, a second straight section 533 extending in the front-rear direction, and a transitional curved section 534 connecting the first straight section 532 with the second straight section 533. Therefore, a substantially L-shaped condenser 503 with an appropriate heat exchange area is formed. The plate section 531 of the back plate 510 corresponding to the condenser 503 is a plate section 531 of the back plate 510 facing the first straight section 532. An ambient airflow entering via the side air vents 521 directly exchanges heat with the second straight section 533, and the ambient air entering via the bottom air inlet 505 directly exchanges heat with the first straight section 532. As such, more ambient air entering the compressor compartment 500 is further concentrated at the condenser 503 to ensure the overall heat dissipation uniformity of the condenser 503.

In an embodiment, the bottom wall of the cabinet 110 is jointly defined by a first horizontal plate 530, part of a bent plate 540, and a second horizontal plate 550. The first horizontal plate 530 is on a front side of the bottom of the refrigerator 100. The bent plate 540 is formed by bending and extending backwards and upwards from a rear end of the first horizontal plate 530. The bent plate 540 extends to be above the second horizontal plate 550. The compressor 501, the heat dissipation fan 502, and the condenser 503 are transversely spaced in sequence on the second horizontal plate 550 and located in a space defined by the second horizontal plate 550, the two side plates 520, the back plate 510, and the bent plate 540. The bent plate 540 includes a vertical portion 541, an inclined portion 542, and a horizontal portion 543. The vertical portion 541 extends upwards from the rear end of the first horizontal plate 530. The inclined portion 542 extends backwards and upwards from an upper end of the vertical portion 541 to be above the second horizontal plate 550. The horizontal portion 543 extends backwards from a rear end of the inclined portion 542 to the back plate 510.

The first horizontal plate 530 and the second horizontal plate 550 are spaced, and a bottom opening is formed therebetween. In an embodiment, the refrigerator 100 further includes a divider 560. The divider 560 is arranged behind the bent plate 540, the front of the divider is connected with the rear end of the first horizontal plate 530 while the back of the divider is connected with the front end of the second horizontal plate 550, and the divider is configured to divide the bottom opening into the bottom air inlet 505 and the bottom air outlet 506 which are transversely arranged. It can be seen from the foregoing that the bottom air inlet 505 and the bottom air outlet 506 in the embodiment of the present invention are defined by the divider 560, the second horizontal plate 550, and the first horizontal plate 530 such that the bottom air inlet 505 and the bottom air outlet 506 are shaped into grooves with relatively large openings to enlarge the air inlet area and the air outlet area, reduce the air inlet resistance, and ensure smoother circulation of the airflow. Moreover, the manufacturing process is simpler, and the overall stability of the compressor compartment 500 is higher.

The inclined portion 542 is at a gap between the first horizontal plate 530 and the second horizontal plate 550 and above the bottom air inlet 505 and the bottom air outlet 506. A slope structure of the inclined portion 542 may further guide and rectify an intake airflow to make the airflow entering via the bottom air inlet 505 flow to the condenser 503 in a more concentrated manner to avoid the condition that the airflow is excessively dispersed and thus cannot pass through the condenser 503 better and further ensure the heat dissipation effect of the condenser 503. Meanwhile, the slope structure of the inclined portion 542 guides an exhaust airflow of the bottom air outlet 506 to the front side of the bottom air outlet 506 to ensure that the exhaust airflow flows out of the compressor compartment 500 more smoothly and further improve the circulation smoothness of the airflow. In a preferred embodiment, an included angle between the inclined portion 542 and the horizontal plane is smaller than 45°. The inclined portion 542 achieves a better airflow guiding and rectification effect at this angle.

In addition, it is unexpected that the inventor of the present application creatively realizes that the slope structure of the inclined portion 542 also has a relatively good suppression effect on an airflow noise. In a development test, the noise of the compressor compartment 500 with the particularly designed inclined portion 542 may be reduced by 0.65 decibels or more.

In addition, in a conventional refrigerator, a bearing plate of a substantially flat-plate structure is usually adopted at the bottom of the cabinet 110, the compressor 501 is arranged on the inner side of the bearing plate, and the vibration of the compressor 501 during running greatly affects the bottom of the cabinet 110. In the embodiment of the present invention, as described above, the bottom of the cabinet 110 is constructed into a three-dimensional structure, and the compressor 501 is borne by the second horizontal plate 550, so that the influence of the vibration of the compressor 501 on other components at the bottom of the cabinet 110 is reduced. In addition, the cabinet 110 is designed into the ingenious special structure as described above, so that the bottom of the refrigerator 100 is compact in structure and reasonable in layout, and the overall size of the refrigerator 100 is reduced. Meanwhile, the bottom space of the refrigerator 100 is fully utilized, and the heat dissipation efficiency of the compressor 501 and the condenser 503 is ensured.

In some embodiments, an air stopping element 570 is further arranged at the upper end of the condenser 503. The air stopping element 570 may be air stopping sponge that fills a space between the upper end of the condenser 503 and the bent plate 540. That is, the air stopping element 570 covers the upper ends of the first straight section 532, the second straight section 533 and the transitional curved section 534, and the upper end of the air stopping element 570 should abut against the bent plate 540 to seal the upper end of the condenser 503 to prevent part of air that enters the compressor compartment 500 from passing through the space between the upper end of the condenser 503 and the bent plate 540 instead of the condenser 503, thereby implementing the heat exchange of the air entering the compressor compartment 500 as much as possible through the condenser 503 to further improve the heat dissipation effect of the condenser 503.

In some embodiments, the refrigerator 100 further includes an air stopping strip 580 extending in the front-rear direction. The air stopping strip 580 is between the bottom air inlet 505 and the bottom air outlet 506, extends from a lower surface of the first horizontal plate 530 to a lower surface of the second horizontal plate 550, and is connected with the lower end of the divider 560. As such, the bottom air inlet 505 is completely isolated from the bottom air outlet 506 by the air stopping strip 580 and the divider 560. In such case, when the refrigerator 100 is placed on a supporting plane, the space between the bottom wall of the cabinet 110 and the supporting plane is transversely divided to allow the external air to enter the compressor compartment 500 via the bottom air inlet 505 on one transverse side of the air stopping strip 580 under the action of the heat dissipation fan 502, sequentially flow through the condenser 503 and the compressor 501, and finally flow out from the bottom air outlet 506 on the other transverse side of the air stopping strip 580. Therefore, the bottom air inlet 505 is completely isolated from the bottom air outlet 506 to prevent the cross flow of the external air entering the condenser 503 and heat dissipating air exhausted from the compressor 501 and further ensure the heat dissipation efficiency.

Hereto, those skilled in the art should realize that although multiple exemplary embodiments of the present invention have been shown and described in detail herein, without departing from the spirit and scope of the present invention, many other variations or modifications that conform to the principles of the present invention can still be directly determined or deduced from contents disclosed in the present invention. Therefore, the scope of the present invention should be understood and recognized as covering all these other variations or modifications.

The invention claimed is:

1. A refrigerator, comprising:

a cabinet, in which are defined a cooling chamber at a lower portion and a first storage compartment and a second storage compartment which are spaced side by side above the cooling chamber; and an evaporator, arranged in the cooling chamber and configured to cool an airflow entering the cooling chamber to form a cooled airflow, wherein at least one first return air inlet communicated with the cooling chamber is formed in a left sidewall of the first storage compartment such that a return airflow of the first storage compartment enters the cooling chamber to be cooled via the first return air inlet;

at least one second return air inlet communicated with the cooling chamber is formed in a right sidewall of the second storage compartment such that a return airflow of the second storage compartment enters the cooling chamber to be cooled via the second return air inlet a water pan, arranged below the evaporator and having a first inclined portion, a second inclined portion, and a water outlet formed at a bottom junction of the first inclined portion and the second inclined portion, wherein the evaporator has a first evaporator portion abutting on the first inclined portion and a second evaporator portion abutting on the second inclined portion;

an air supply duct, formed between the first storage compartment and the second storage compartment, wherein the air supply duct has at least one first air supply opening communicated with the first storage compartment and at least one second air supply opening communicated with the second storage compartment such that the cooled airflow is delivered to the first storage compartment via the first air supply opening and to the second storage compartment via the second air supply opening; and an air supply fan, configured to cause the cooled airflow to flow to the first storage compartment and/or the second storage compartment, wherein the air supply fan is a cross-flow fan arranged between the first evaporator portion and the second evaporator portion, an air outlet of the cross-flow fan is communicated with the air supply duct, and the cooled airflow is driven by the cross-flow fan to enter the air supply duct.

2. The refrigerator according to claim 1, further comprising:

a first top cover plate, arranged above the evaporator and having an inclined plane which is arranged corresponding to the first inclined portion with the first evaporator portion arranged therebetween; and a second top cover plate, arranged above the evaporator and having an inclined plane which is arranged corresponding to the second inclined portion with the second evaporator portion arranged therebetween.

3. The refrigerator according to claim 1, further comprising:

a first air duct separator having the first air supply opening formed therein; and a second air duct separator having the second air supply opening formed therein, wherein the first air duct separator and the second air duct separator are arranged opposite to each other with the air supply duct formed therebetween.

4. The refrigerator according to claim 3, further comprising:

a first supporting block, arranged in front of a rear sidewall of the cabinet; and a second supporting block, arranged in the front of the cabinet and opposite to the first supporting block, wherein the first air duct separator and the second air duct separator are fixed by the first supporting block and the second supporting block.

5. The refrigerator according to claim 4, further comprising:

a reinforcing column, arranged in the first supporting block and/or the second supporting block to improve the strength thereof.

6. The refrigerator according to claim 1, wherein both the first storage compartment and the second storage compartment are freezer compartments.

* * * * *